US005530297A

United States Patent [19]

Rudy, Jr. et al.

[11] Patent Number: 5,530,297

[45] Date of Patent: Jun. 25, 1996

[54] WIRE RETAINER FOR CURRENT MODE COUPLER AND METHOD FOR RETAINING WIRES

[75] Inventors: William J. Rudy, Jr., Annville; Howard R. Shaffer, Millersburg; Daniel E. Stahl, Harrisburg, all of Pa.

[73] Assignee: The Whitaker Corporation, Wilmington, Del.

[21] Appl. No.: 284,951

[22] Filed: Aug. 2, 1994

Related U.S. Application Data

[62] Division of Ser. No. 996,759, Dec. 24, 1992, Pat. No. 5,360,352.

[51] Int. Cl.[6] ..... H01R 13/00

[52] U.S. Cl. ..... 307/104; 336/176; 439/469; 361/600; 361/601; 361/603

[58] Field of Search ..... 307/104; 336/176; 361/601, 603, 679, 728, 826, 827; 439/409, 469, 472, 460, 470, 456, 459

[56] References Cited

U.S. PATENT DOCUMENTS

| | | | |
|---|---|---|---|
| 3,744,009 | 7/1973 | Teagno et al. | 339/128 |
| 3,836,885 | 9/1974 | Larsile | 339/75 R |
| 3,958,300 | 5/1976 | Tanaka | 16/2 |
| 4,006,959 | 2/1977 | Hopkins et al. | 339/113 |
| 4,163,598 | 8/1979 | Bianchi et al. | 339/107 |
| 4,190,222 | 2/1980 | Appleton et al. | 439/456 |
| 4,264,827 | 4/1981 | Herzog | 307/17 |
| 4,461,528 | 7/1984 | Durand et al. | 339/98 |
| 4,781,615 | 11/1988 | Davis et al. | 439/395 |
| 4,826,441 | 5/1989 | Palmer, III | 439/79 |
| 4,842,546 | 6/1989 | Song | 439/409 |
| 4,861,943 | 8/1989 | Yarmack | 174/52.1 |
| 4,904,879 | 2/1990 | Rudy, Jr. et al. | 307/17 |
| 4,995,830 | 2/1991 | Eckhaus | 439/409 |
| 5,030,133 | 7/1991 | Rudoy | 439/409 |
| 5,041,009 | 8/1991 | McCleerey | 439/405 |
| 5,105,095 | 4/1992 | Rudy, Jr. et al. | 307/17 |
| 5,112,247 | 5/1992 | Rudy, Jr. et al. | 439/571 |
| 5,241,219 | 8/1993 | LeBaron et al. | 307/104 |

OTHER PUBLICATIONS

*AEEC Letter No. 87–094/SAI–309*, Jul. 17, 1987; pp. 1, 7, 9; Aeronautical Radio Inc., Annapolis, MD.

*AEEC Letter No. 87–122/SAI–313*, Sep. 17, 1987; pp. 1, 38–44; Aeronautical Radio Inc., Annapolis, MD.

*AEEC Letter No. 88–077/SAI–331*, May 20, 1988; pp. 1, 12; Aeronautical Radio Inc., Annapolis, MD.

ARINC Specification 629, p. 29 [copy not enclosed but in parent application].

*Primary Examiner*—William M. Shoop, Jr.
*Assistant Examiner*—Peter Ganjoo
*Attorney, Agent, or Firm*—Anton P. Ness

[57] ABSTRACT

An improved current mode coupler comprising a base (100), a housing (300) mountable to a panel. The coupler base (100) includes a pair of wire retainers (200) for securing the wires (230,231) of a twisted pair cable within wire receiving channels (204,205) of a wire nest (202) of the coupler base (100). Each wire retainer (200) has an arm (232), a strut (236) extending from one end thereof to a cylindrical hinge (234) disposed in a pivot region of the coupler base (100), a vertical section (240) proximate the other end including a latch (242), and a wedge (244) on the lower surface of the arm (232). Upon rotation of the wire retainer about hinge (234) to a closed position, wedge (244) is engageable with a lower one of the conductors (230) to urge it fully into a deeper one of the channels (204) adjacent a channel intersect ion proximate a conductor crossover.

8 Claims, 9 Drawing Sheets

WIRE RETAINER FOR CURRENT MODE COUPLER AND METHOD FOR RETAINING WIRES

This application is a Divisional of application Ser. No. 07/996,759 filed Dec. 24, 1992 U.S. Pat. No. 5,360,352.

FIELD OF THE INVENTION

The present invention relates to the field of electrical connectors and more particularly to a wire retention system of a noninvasive coupler for sensing and transmitting electrical signals from a conductor wires of a twisted pair cable of a data bus.

BACKGROUND OF THE INVENTION

Non-invasive data current mode couplers are planned to be used extensively aboard aircraft for transmitting signals from conductive wires of a twisted pair cable of a data bus. A current mode coupler typically includes a base to which is secured a housing to form an assembly for noninvasive coupling to a twisted pair of signal conductor wires of a closed loop data bus to read signals being transmitted therealong by a series of electromagnetic cores interlaced with respective loops of the twisted pair. The electromagnetic cores comprise pairs of opposing unique E-shaped electromagnets each member of which is disposed within one or the other of the base or housing. Opposing end faces of the legs of the E-shaped electromagnets engage each other by a resilient bias means after portions of the individual wires of the twisted pair of digital conductor wires at a selected location therealong are placed in formed twisted pair channels of a wire nest extending between the legs of the electromagnets in the base, so that one loop of the twisted pair cable is disposed in the wire nest.

The electronics housing includes an electronics package electrically connected to an electronic subassembly connected to a circuit board element. In turn, the electronic subassembly is electrically connectable at a connector interface of the housing with a cable assembly which extends to a corresponding control unit, with the control unit providing electrical power to the electronic subassembly as well as signal and ground connection. The current mode coupler also can transmit and amplify signals therealong by generating an appropriate electromotive force via an electromagnetic field, and also receive and therefore verify the signal it transmits.

For example, U.S. Pat. No. 5,105,095 describes a data coupler insert having conductive wires positioned within arcuate channels in the top surface of an elastomeric body in the coupler base formed to include channel intersections proximate cable exits adapted for accommodation of crossovers of the conductor wires at ends of a single loop of the cable, with one channel portion being a conductor diameter deeper than the other. Electromagnetic shielding by using metallic plating on the housing provides EMI/RFI protection. A resilient spring means biases the electromagnetic insert so as to bias together each electromagnet pair to form an electromagnetic core. Sealing means are used to position and seal the conductive wires in the assembly. A mounting means secures the coupler base to a panel, as also described in U.S. Pat. No. 5,112,247, and aligning means precisely secures the housing of the data coupler assembly to the base.

U.S. Pat. No. 4,904,879 describes a data current mode coupler, and method of making and assembling the coupler, for receiving signals from a conductor wires of a twisted pair of a data bus. The coupler assembly noninvasively couples the data bus to the conductor wires by using mating pairs of E-shaped electromagnets having windings about central legs of the electromagnets which are electrically connected to a control unit to sense and transmit signals along the data bus. A base having a cavity to receive conductor wires positioned adjacent to the lower electromagnets is mounted to a panel. A housing with upper electromagnets includes a circuit substrate having trace windings about substrate apertures, an electronic subassembly to which the windings are electrically connected to amplify transmitted and received signals, and a shielded electrical connector secured at a connector end connected to circuits of the electronic subassembly and matable with a connector of a cable extending to the control unit. The housing is releasably connected to the housing via a fastening means and securing means.

U.S. Pat. No. 4,264,827 discloses a method of sensing the transmission of low-level signal current through an electrical conductor without an electrical connection to the conductor, using a continuous closed loop conductor wire extending from a current source with coils of the conductor looped around magnetic coil articles connected to electronic devices, which arrangement senses changes in the electromagnetic field established by the current. The arrangement can be repeated at a plurality of locations spaced along the conductor without detrimental effect to the signal transmission, and can allow signaling of a plurality of electronic devices in response to the signal current passing through the conductor.

Such a current sensing system is desired to be placed aboard aircraft for use with black boxes and other electronic control units, as is disclosed in ARINC Standard 629 recently issued by the Airlines Electronic Engineering Committee (AEEC) of Aeronautical Radio, Inc. (ARINC) of Annapolis, Md., and AEEC Letters Nos. 87-094/SAI-309, 87-122/SAI-313, and 88-077/SAI-331, which are incorporated herein by reference. Such a system may also be used in other environments where it is desired that a single closed loop data bus be used.

The couplers above provide important advantages in operation and assembly. Nevertheless, none of these data current mode couplers uses single-motion panel-mounting means, a wire retainer disposed to secure the conductors of the twisted pair in the elastomeric wire nest for wire positioning within the wire channels, and a housing having improved heat transfer characteristics and electromagnet shielding using a finned housing. It is desired to devise an improved noninvasive coupler for sensing and transmitting electrical signals from a twisted pair of a data bus, which provides these important advantages.

SUMMARY OF THE INVENTION

The present invention is a wire retainer for use with a current mode coupler assembly to noninvasively couple to conductors of a twisted pair cable of a data bus, where the coupler defines at least one mated pair of opposed E-shaped electromagnets defining an electromagnet coil about each conductor wire, upon full coupler assembly. One loop of the twisted pair cable is contained in the wire nest, with conductor crossovers adjacent the cable exits being disposed in channel intersections where the portion of one of the channels is a conductor diameter deeper thereat than the other.

Each wire retainer is affixed to the coupler base at a respective cable exit and is movable between open and closed positions permitting routing of the conductors generally along the respective channels in the open position, and urging the conductors into the channels when moved to the closed position. A wedge along the conductor-proximate surface of an arm of the retainer is opposed to the deeper channel portion at an intersection, and urges the relatively lower conductor of the pair at the crossover thereinto, while an adjacent surface of the arm urges the relatively upper conductor into its respective relatively shallow channel portion.

A strut extends from one end of the arm to a cylindrical hinge extending laterally beyond sides of the strut to be seated in a pivot region of the coupler base to offset from a cable exit; a vertical portion depends from the other end of the arm and includes a latch along its hinge-proximate surface to latch to a recess of the coupler base in the closed position; and a lever extends from the outer surface of the vertical portion facilitating manual rotation of the wire retainer between open and closed positions.

One advantage of the present invention is the proper positioning of the conductors fully into respective channels at channel intersections adapted for conductor crossovers.

Another advantage is the securing of the conductors within the wire nest prior to and during manipulation of the upper coupler housing into position atop and against the panel-mounted coupler base, thereby mating the end faces of the legs of the opposed electromagnets of each pair to define electromagnet coils about the conductors in the wire nest.

Yet another advantage is the providing of general protection of the conductors from strain, exposure and wear during in-service use while permitting wire removal during repair and servicing.

Still another advantage is the ease of affixing the wire retainer to the coupler base into position permitting rotation between open and closed positions, while remaining attached to the coupler base, all without fastener hardware, and in a manner permitting removal from the coupler base if desired.

The invention itself, together with further objects and attendant advantages, will best be understood by reference to the following description taken in conjunction with the accompanying drawings.

DETAILED DESCRIPTION OF THE INVENTION

Figure 1:
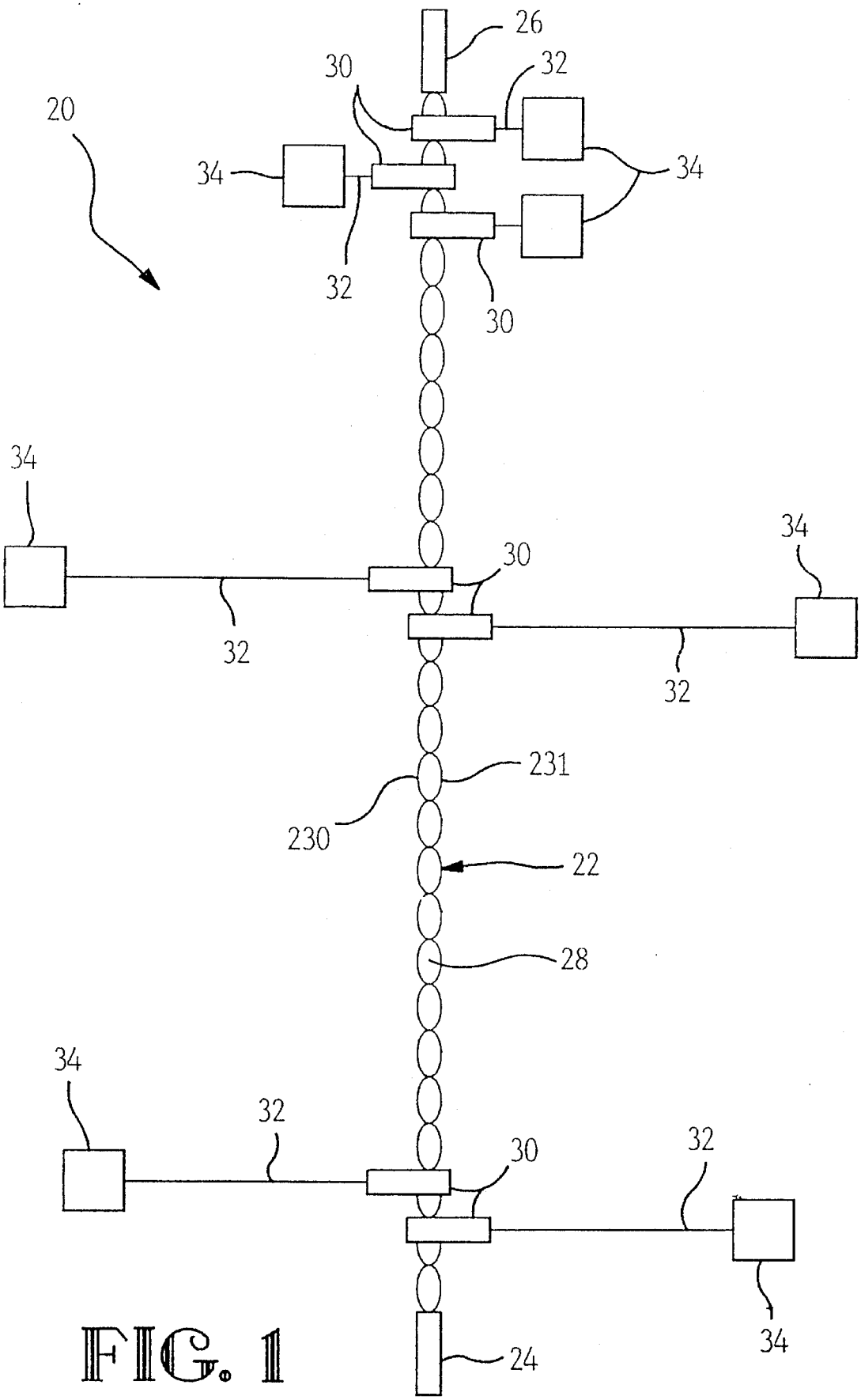
FIG. 1 is a diagrammatic view of a data bus system.

Turning now to the drawings, FIG. 1 shows a representation of the data bus system 20 to which the present invention is relevant. A twisted pair cable 22 of conductor wires 230,231 extends between end terminations 24,26 and comprises a closed loop, and a plurality of loops 28 occur at selected spacing, each loop having a length and shape selected to minimize impedance effects and signal reflection. At selected loops 28 are mounted current mode coupler assemblies 30 each having a width preferably less than a loop length to avoid distorting the desired loop length and shape, thereby avoiding impedance effects and signal reflection. Stub cables 32 extend from respective coupler assemblies 30 to respective control units 34 such as black boxes, providing electrical connections therebetween. Each control unit 34 preferably has a Serial Interface Module (not shown) for modifying digital signals from Manchester Encoded Signals to be transmitted along the data bus system, and correspondingly for translating such encoded signals into digital signals for integrated circuits within the control unit. Each control unit 34 will also provide power for the amplifiers in a respective coupler assemblies 30 to boost received and transmitted signals.

In the assembled coupler, in which the twisted pair cable of wires passes through the electromagnet channels formed by the mated electromagnets in the coupler housing and the coupler base, signals transmitted through the twisted pair of signal conductor cables to the control unit are inductively coupled to the control unit. Similarly, signals sent from the control unit are inductively coupled to the twisted pair cable conductor wires. Signals sent in either direction, either from the control unit, or through the twisted pair cable, are amplified by the signal amplifier in the electronics of the housing.

Figure 2:
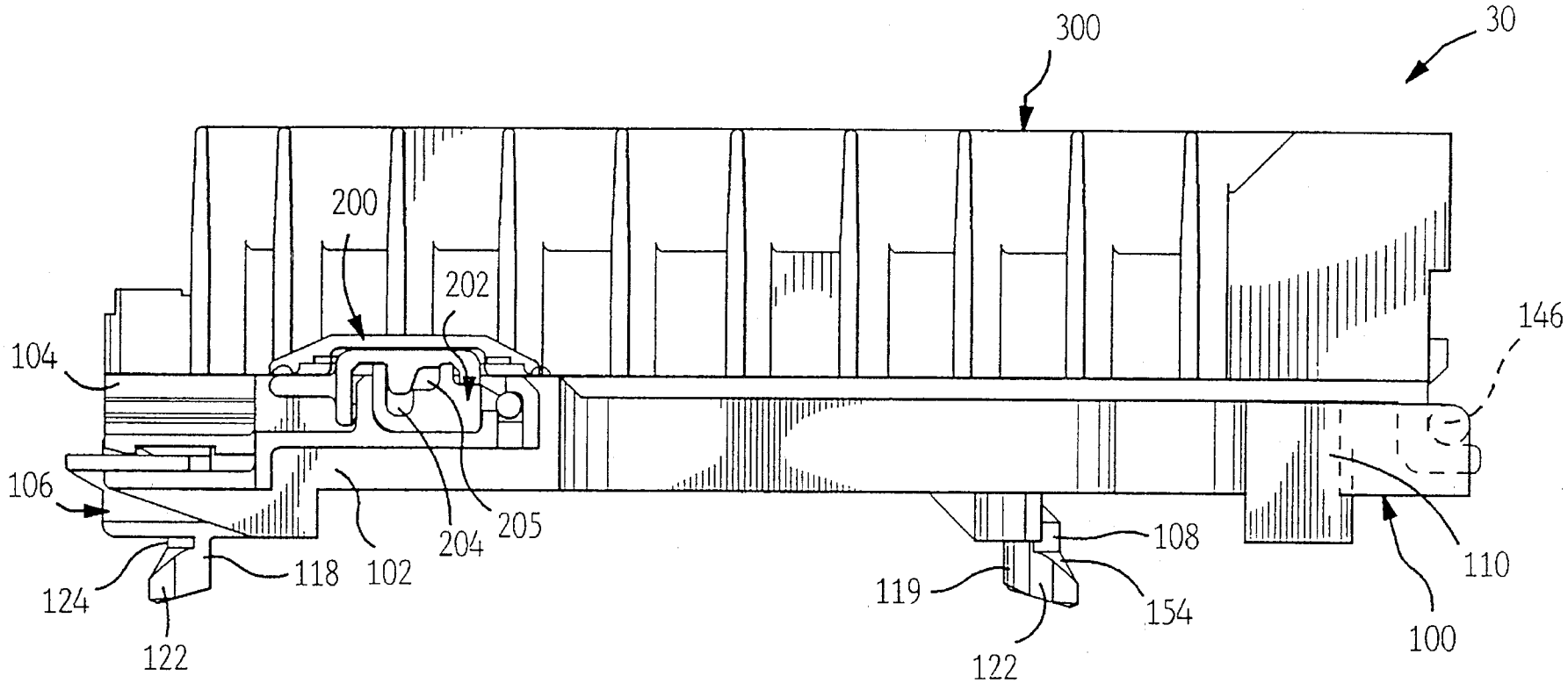
FIG. 2 is an elevation view of a current mode coupler assembly having a panel-mountable base and a heat dissipating housing.

The coupler assembly 30 of the present invention is coupled to the twisted pair 22 of conductor wires 230,231 of a data bus system 20 such as that of FIG. 1 and as disclosed in U.S. Pat. Nos. 4,904,879 and 4,264,827, and the AEEC Letters referred to herein. The coupler assembly 30 is non-invasively affixed at a selected location therealong at a loop 28 of the twisted pair. Each coupler assembly 30 comprises a coupler base disposed to include a elastomeric wire nest member having legs of a pair of E-shaped electromagnets extending to the top surface thereof, and having channels coursing therealong to receive respective conductor wires of a twisted pair cable around the center electromagnet legs. A housing assembly 300 is disposed to be removably secured to the base, as shown in FIG. 2. Housing 300 contains E-shaped electromagnets associated with and opposing the electromagnets of the coupler base; an electronics package containing electronic components within an enclosed shielded cavity, the electronics package including circuitry having windings around center legs of each E-shaped electromagnet within housing 300; and an electrical connection port enabling connection to a control unit. The base is mounted to a panel at a location along the data bus 20 of FIG. 1 by a single-motion panel-mounting system, at which position the housing receives ambient air flow to cool the electronics in the housing.

Figure 3:
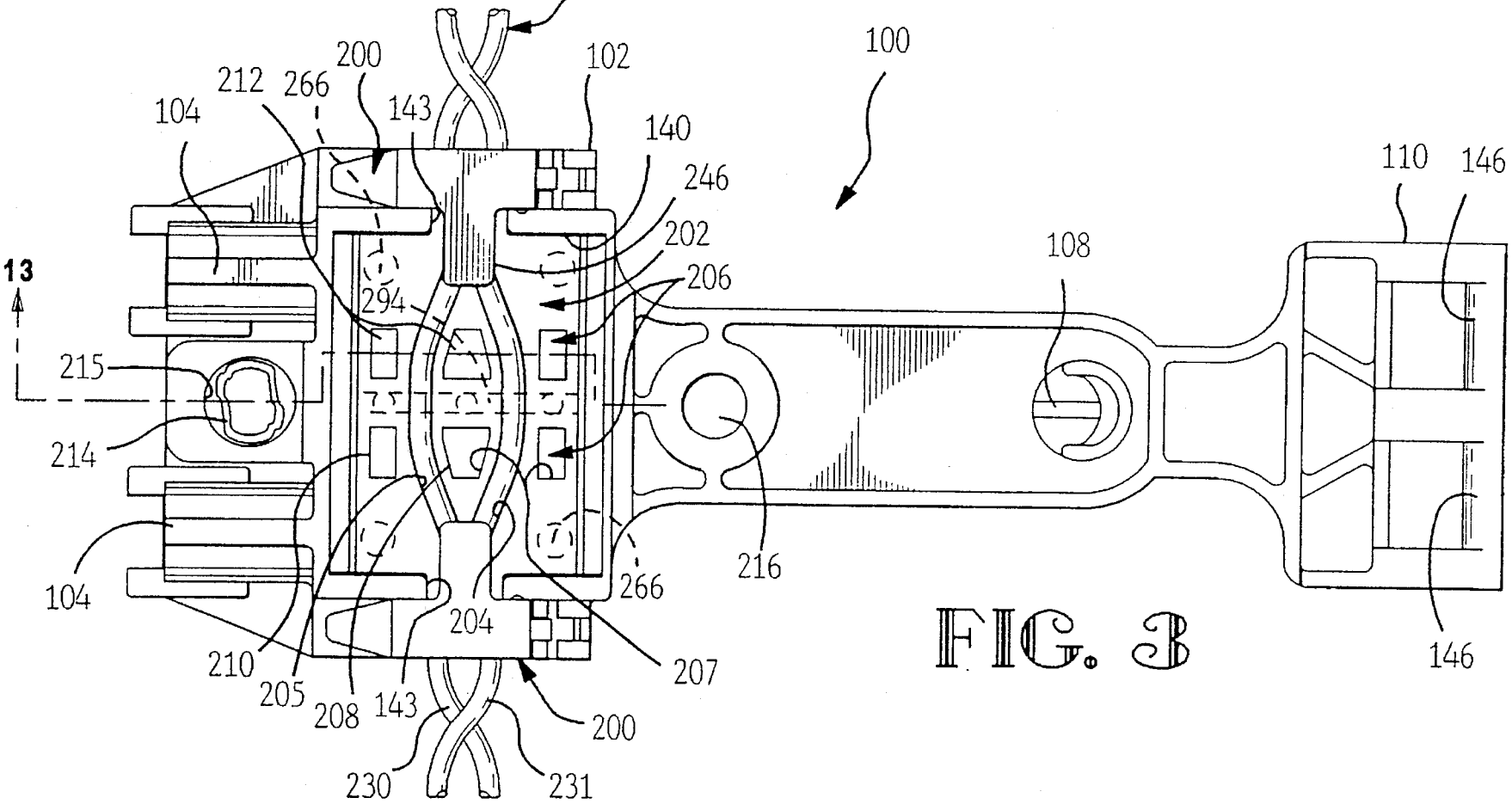
FIG. 3 is a plan view of the coupler base in which is disposed the wire nest with electromagnets therein with the conductors of the twisted pair cable disposed in channels coursing around the central electromagnet legs, held therein by wire retainers of the present invention.
Figure 4:
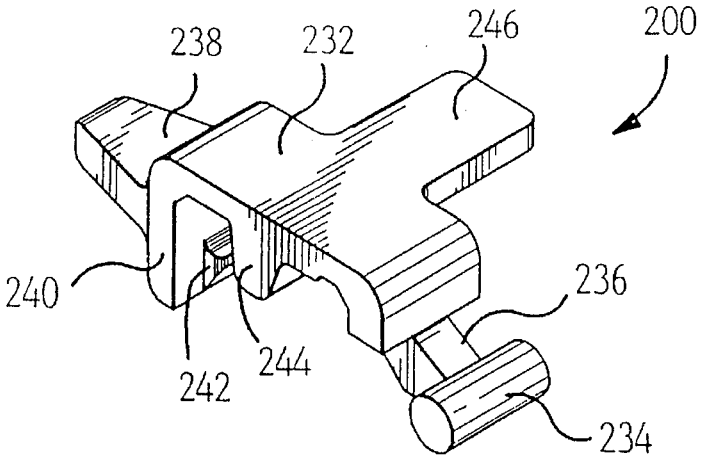
FIGS. 4 to 6 show several isometric views of a hinged wire retainer of the present invention.
Figure 5:
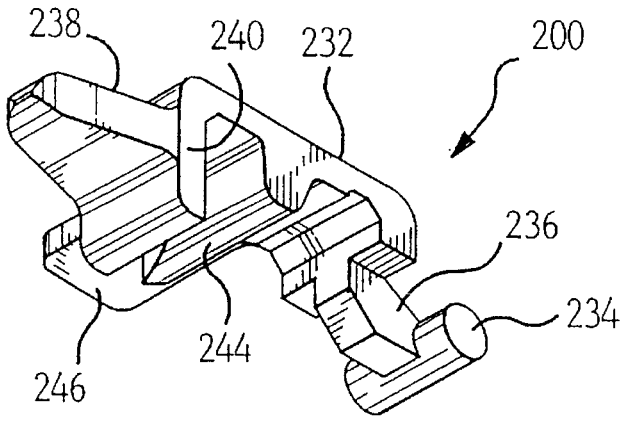
Figure 6:
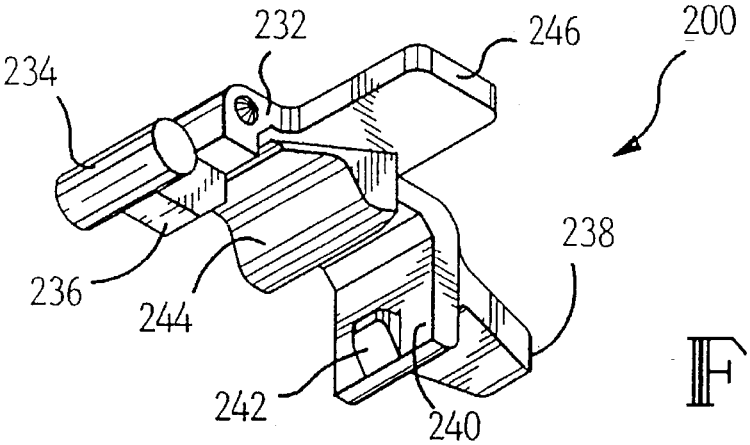
Figure 7:
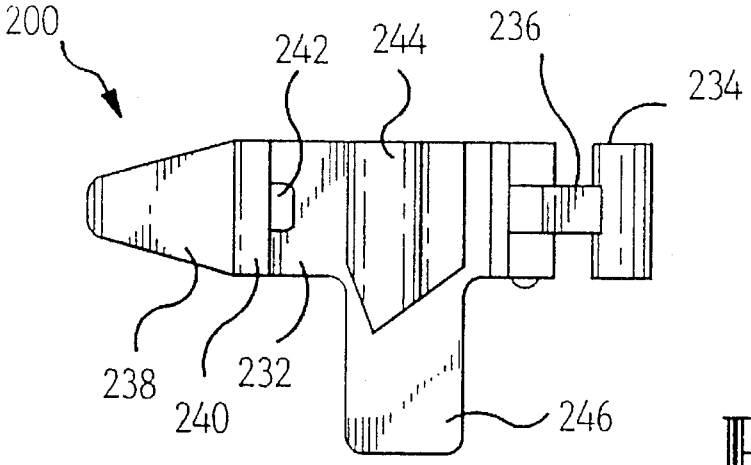
FIGS. 7 to 9 are bottom, elevation and end views of the hinged wire retainer.
Figure 8:
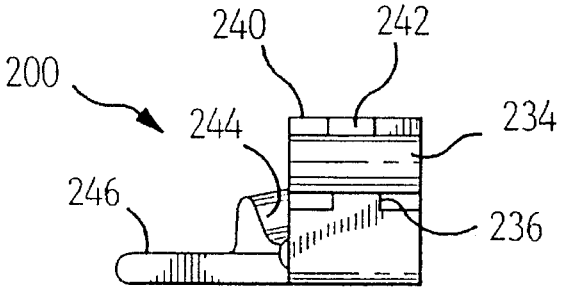
Figure 9:
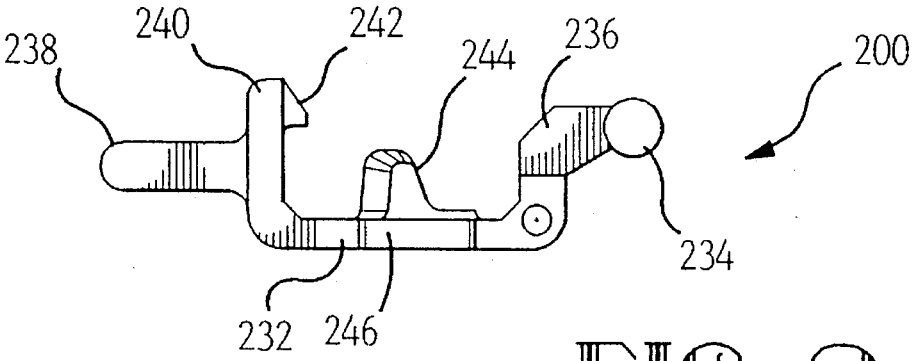

Referring to FIGS. 2 and 3, the coupler base 100 comprises a twisted pair end 102 generally containing a wire nest 202 having wire channels 204,205 along which will be disposed conductors of the twisted pair cable of the data bus 20, retained therein by wire retainers 200 at each cable exit; twisted pair end 102 also includes an aperture 215 within which is disposed securing means 214 for securing coupler housing 300 to coupler base 100. Twisted pair end 102 includes a pair of projections 104, movable mounting means or a pair of mounting body members 106 extending from the coupler base 100, a fixed engaging member 108 located between the twisted pair end 102 and a pivot end 110 opposite the twisted pair end 102, altogether defining a single-motion panel-mounting system as disclosed in U.S. patent application Ser. No. 07/996,558 filed Dec. 24, 1992 now Ser. No. 08/226,200 filed Apr. 11, 1994. Coupler housing 300 includes an array of diagonal fins cooperable with ambient air flow facilitating heat dissipation during in-service use, and is disclosed in U.S. patent application Ser. No. 07/996,762 filed Dec. 24, 1992.

Each mounting body member 106 comprises an engaging section or foot 118 which depends from a horizontal cylinder section 121 and includes an angled foot end 122 on its lower surface, and a locking surface or groove 124 thereinto for securing the mounting body member 106 (and base 100) to a panel at a peripheral edge of a hole or cutout therethrough. Similarly, fixed engaging member 108 includes an engaging section 119 with an angled foot end 122 and a locking surface or groove 154.

Turning to FIG. 3, a top plan view of the coupler base 100 illustrates the wire nest 202 with conductors 230,231 of the twisted pair cable 22 at a loop 28 being moved slightly apart horizontally thus expanding the loop, and disposed along channels 204,205 of wire nest 202, secured in place by a pair of hinged wire retainers 200. The coupler base 100 includes a twisted pair end 102 having projections 104 utilized with the mounting system; a wire nest 202 within a cavity 140 and containing a pair of electromagnets 206, a pair of conductors 230,231 and a wire retainer 200; a fixed engaging member 108 and a pivot end 110 whereat pivot pins or dowels 146 are located. The electromagnet receiving cavity 140 on the twisted pair end 102 is shown with wire nest 202 therein comprising a body of elastomeric material which includes wire channels 204,205 for receiving respective conductor wires 230,231 of a twisted pair cable 22 of a data bus system 20 as depicted in FIG. 1. The pair of wire retainers 200 act to secure the twisted pair cable conductors into the wire channels 204 at the respective cable exit slots 143.

Each electromagnet 206 comprises a center leg 208 and two outside legs 210, which legs 208,210 extend upwardly from a crossing section and through leg-receiving holes 207 through the wire nest 202 and terminate in mating faces 212.

As shown in FIG. 3, the coupler base 100 includes an aligning recess 216 to receive an upper member aligning means during assembly of housing 300 to coupler base 100. Pivot pins or dowels 146 positioned at the pivot end 110 of the coupler base 100 cooperate with projections extending from the pivot end of a coupler housing 300 in the assembled current mode coupler 30, as seen in FIG. 2, to permit pivoting of the housing to a closed coupled position atop coupler base 100. A securing aperture 214 is defined in base 100 and includes securing means 215 for attaching the coupler base 102 to a coupler housing 300 upon complete coupled assembly such as by use of a quarter-turn fastener.

A wire retainer 200 according to the present invention is shown in FIGS. 4 to 11 preferably to include an arm 232, a cylindrical hinge or dowel 234 disposed at an end of strut 236 and extending laterally beyond the sides thereof, and a lever 238 extending from an outer surface of a vertical section 240 of arm 232. A latch 242 is disposed on an inner surface of vertical section 240 of the arm 232 at a position opposite the cylindrical hinge 234. A wedge 244 depends from the lower surface of arm 232 proximate vertical section 240, and protective hood or cover 246 extends laterally from arm 232 inwardly toward and over wire nest 202 upon being assembled to coupler base 100.

Figure 10:
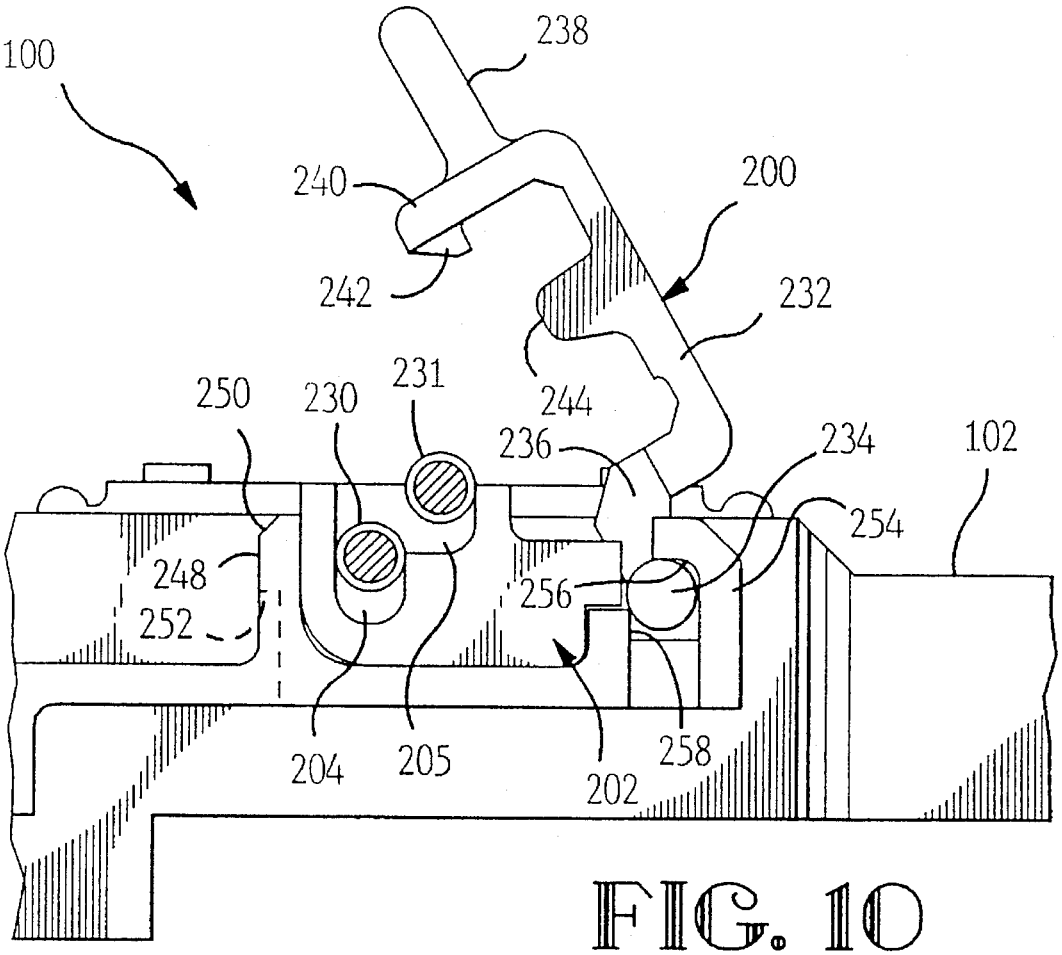
FIGS. 10 and 11 are elevation views of a coupler base with the hinged wire retainer of the present invention first in the open position relative to the twisted pair cable and then in the closed position with the conductors of the twisted pair cable fully inserted into the channels of the elastomeric body of the wire nest.
Figure 11:
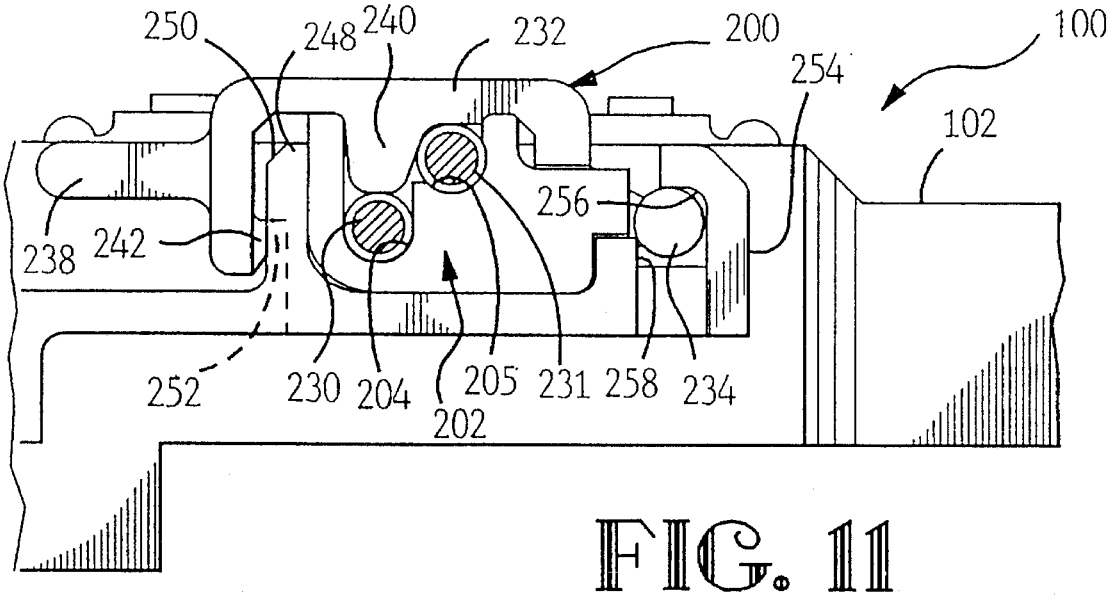
Figure 14:
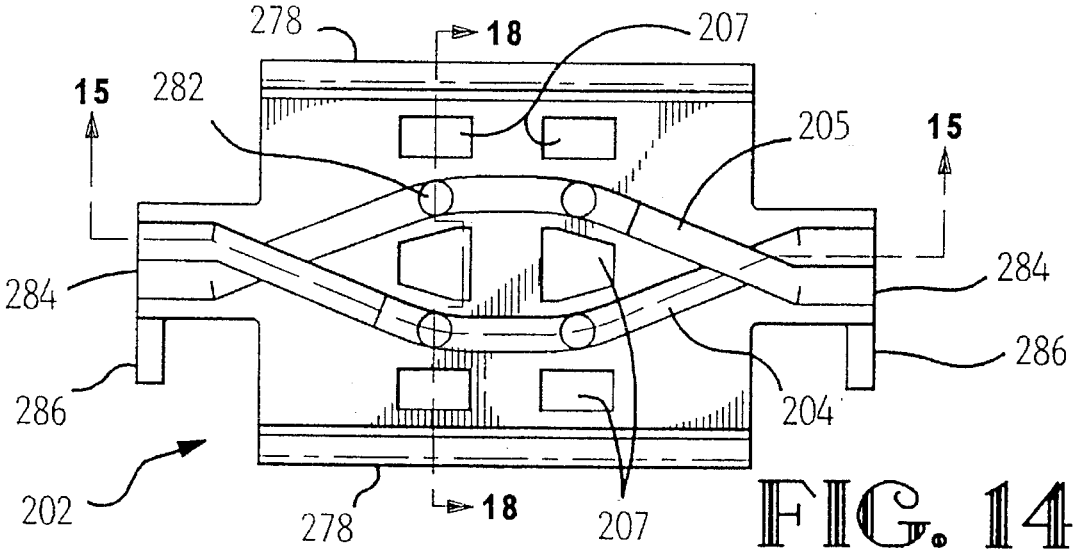
FIG. 14 is a top view of the elastomeric wire nest of the coupler base according to the present invention.

In FIG. 10 is shown coupler base 100 with a wire retainer 200 in the open position to the twisted pair cable with arm 232 perpendicular to coupler base 100, and in FIG. 11 wire retainer 200 has been rotated to the closed position. Wire channels 204,205 are defined along the top surface of elastomeric wire nest 202 extending from side to side of coupler base 100 and including adjacent support surfaces at their ends (preferably at staggered depths outwardly of conductor crossovers at the cable exits as shown in FIG. 14), and conductor wires 230,231 of the twisted pair cable 22 of FIG. 1 are also shown. A like retainer is assembled to coupler base 100 along the opposite side, and may be a mirror-image member likewise rotatable so that both members secure wires 230,231 within wire nest 202.

When wire retainer 200 is rotated down towards the current mode coupler base 100, the wedge 240 contacts a first wire of the twisted pair cable 231. The wedge 244 positions the first wire of the twisted pair cable 231 into the appropriate deeper wire channel 205. When the wire retainer 200 is lockingly engaged, the wedge 244 also positions the second wire 230 of the twisted wire cable into the appropriate wire channel 204. Thus, when the wire retainer 200 is lockingly engaged, the wedge 244 secures the positions of the first 231 and second 230 wires of the twisted pair cables in their respective wire channels 205,204, respectively, adjacent channel intersections at the wire crossovers at ends of a loop 28 (see FIG. 1).

A wall 248 upwardly extends from the current coupler base 100. The top of the wall 248 has an angled edge 250 complementary to a tapered downwardly facing bearing surface of latch 242. When the wire retainer 200 is rotated downward, latch 242 contacts the angled edge 250, such that when force is applied to the wire retainer 200 (for example, by applying downward force to the optional lever 238, latch 242 slides down the outer surface of the wall 248. Wall 248 located in the coupler base 100 has a latching recess 252 defined within its outer or forwardly facing surface, so that when the wire retainer 200 is fully rotated downward, latch 242 lockingly engages into latching recess 252, so as to secure the position of the wire retainer 200 onto the coupler base 100. The wire retainer 200 may only be unlocked from the current coupler base 100 by applying upward force to the wire retainer 200, such as by applying upward force to the optional lever 238 shown in this example. With sufficient upward force applied onto lever 238, vertical section 240 of arm 232 will deflect outwardly so that latch 242 will disengage from the cavity 252, and latch 242 will slide up the outer surface of the wall 248, so that the wire retainer 200 is freely rotatable.

The interconnection of the wire retainer 200 to the coupler base 100 is as follows, referring to FIGS. 10 and 12. A pair of claws 254 are spatially defined onto the coupler base 100 along each side preferably spaced toward pivot end 110 from cable exits 143, and include forwardly extending portions 256 defining bearing surfaces 258 therebeneath. Staggered just forwardly of ends of forwardly extending portions 256 are a pair of embossments 260 extending upwardly to define a gap 262 therebetween less than the diameter of cylindrical hinge 234 of wire retainer 200; gap 262 is just larger than a narrow vertical dimension of strut 236 of wire retainer 200. A spacing 262 is defined between the pair of claws 254 and the embossments 260; spacing 264 is just larger than a narrow horizontal width of strut 236 of wire retainer 200. The claws and embossments thus define a hinge-receiving pivot region.

The cylindrical hinge 234 slides underneath the forwardly extending portions 256 of claws 254, as strut 236 is passing through gap 262 during assembly of wire retainer 200 to coupler base 100 from the side thereof while oriented at an angle about 45° or midway between the open and closed orientations. Claws 254 and their forwardly extending portions 256 engage each end of the cylindrical hinge 234 extending laterally from strut 236. Spacing 264 between the claws 254 and embossments 260 is such that strut 236 may fit between the claws and the embossments throughout the range of positions between the open and closed positions of wire retainer 200, and wire retainer 200 is freely pivotable about hinge or dowel 234 against bearing surface 258 even allowing a 180° rotation of the wire retainer 200. It can be seen that wire retainer 200 remains secured to coupler body 100 when unlatched in any open position, except at one particular angle, and thus does not become inadvertently detached while being opened for routing conductors 230,231 into respective channels 204,205, but may still be removed if desired such as for replacement.

Referring to FIGS. 12 to 19, securing posts 266 are shown which enter apertures 268 (FIG. 16) in the elastomeric wire nest 202 in the electromagnet receiving cavity 140 for stabilizing the elastomeric material and thus the electromagnets, with the elastomeric wire nest 202 secured in cavity 140 preferably by adhesive material.

Figure 12:
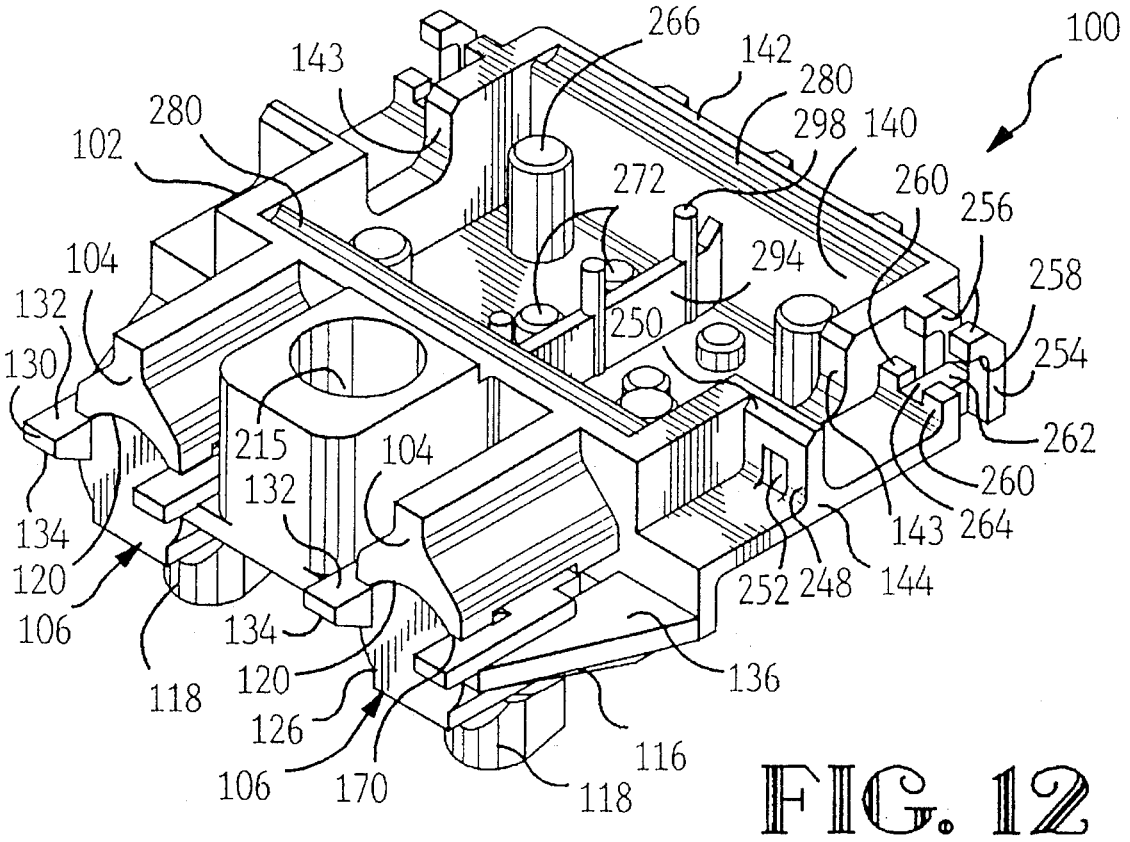
FIG. 12 is an isometric view of the twisted pair end of the coupler base illustrating the cavity into which the wire nest and electromagnets are to be disposed.
Figure 13:
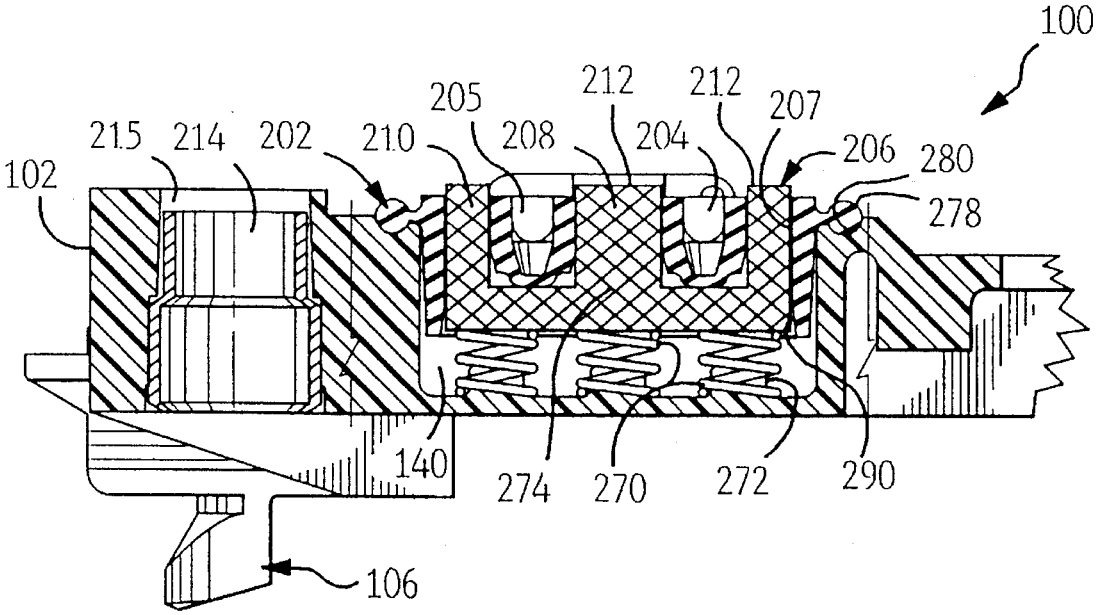
FIG. 13 is a partial cross sectional view of the twisted pair end of the coupler base along line 13—13 of FIG. 3 and showing an electromagnet disposed within the elastomeric wire nest secured in the cavity of the coupler base.

As can be seen in FIGS. 12 and 13, the electromagnet receiving cavity 140 includes an array of springs 270 positioned on embossments 272 along the bottom of cavity 140, the springs applying force in the upward direction to bias upwardly the transverse body section 274 of the associated E-shaped electromagnet 206 when coupler housing 300 is assembled and secured to coupler base 100 to mate the opposing pairs of "E" shaped electromagnets at mating faces 212 to define coils about the conductors 230,231. Elastomeric wire nest 202 includes along its top surface wire receiving channels 204,205 which are shown between the center leg 208 and outer legs 210 of electromagnet 206. Also shown in FIG. 13 is a mounting body member 106 and the securing means 214 on the front end of the coupler base 100 positioned within the securing aperture 215 for attaching the coupler base 100 to a coupler housing 300 (FIG. 2) by means of a quarter-turn fastener (not shown), for example, of the type sold by Southco, Inc. of Lester, Pa. under Part Nos. 82-11-240-16, 82-32-101-20, and 82-99-205-15.

Turning to FIG. 14, a top view of an elastomeric wire nest 202 of the coupler base according to the present invention is shown. Wire nest 202 includes wire receiving channels 204,205 which are positioned between spaces 207 where the legs of an electromagnet (not shown) may be positioned. Cylindrical sealing lips 278 extend along forward and rearward edges along the top surface, which will be disposed in complementary sealing grooves 280 just forwardly and rearwardly of cavity 140 (see FIG. 12). Depressions 282 are seen within the wire receiving channels 204 formed by the wire nest 202, which provide for keeping electromagnets 206 and elastomeric nest 202 in proper positional relationship. Laterally extending sections 284 are shown extending outwardly through cable exits 143, and including support surfaces at ends of channels 204,205 having staggered depths and include rearwardly extending tabs 286 extending past the outer surfaces of struts 236 of wire retainers 200, enhancing the sealing of the cavity 140.

Figure 15:
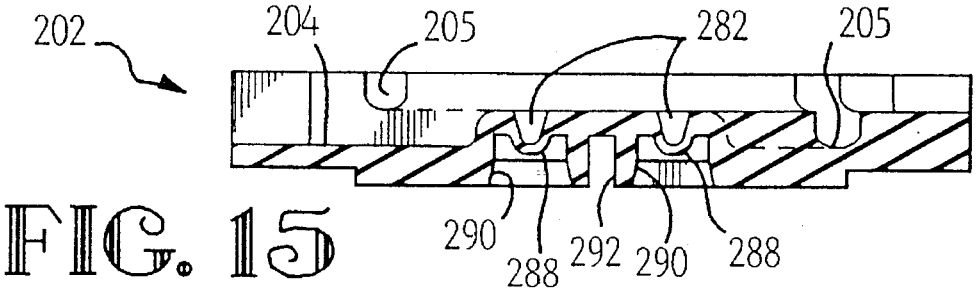
FIG. 15 is a cross section of the wire nest along line 15—15 of FIG. 14.
Figure 16:
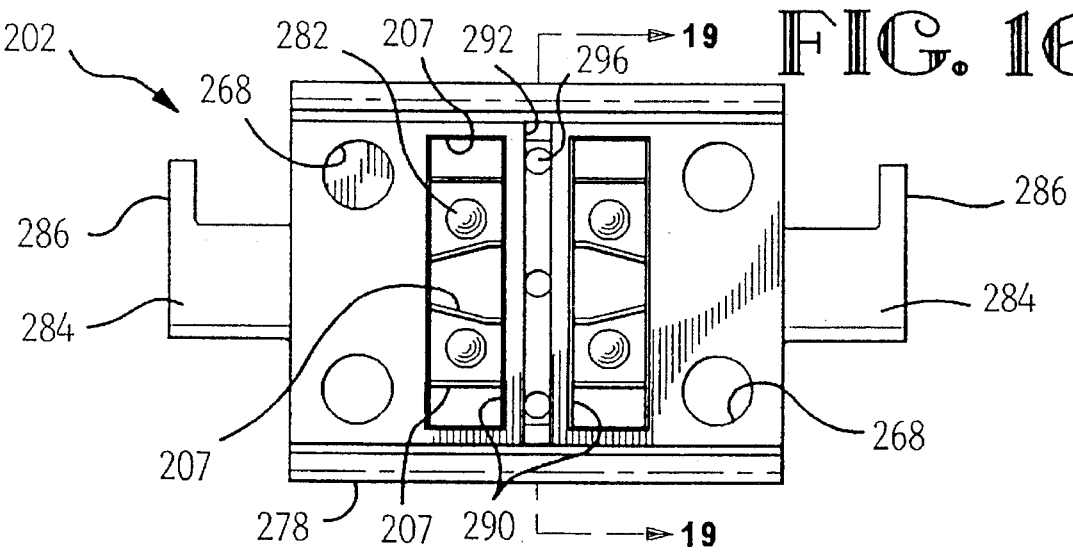
FIGS. 16 and 17 are bottom and side views of the wire nest of the coupler base.

Turning to FIG. 15, a partial cross section of an elastomeric wire nest body 202 along wire channel 204 illustrating dimples 288 below depressions 282 which depend into transverse slot 290 into which transverse body section 276 of an electromagnet 206 and springs 270 around embossments 272 will be disposed. As seen in FIG. 16, spaces 207 for the legs of an E-shaped electromagnet (see FIG. 13) are positioned in the wire nest 202. Medial slot 292 extends upwardly from the bottom surface of wire retainer 202 to receive thereinto a low height wall section 294 extending upwardly from the bottom of cavity 140 between the electromagnet sites to further stabilize the elastomeric material maintaining the position of the electromagnets to be positioned opposed from the mating electromagnets secured in the coupler housing 300 (FIG. 2).

Figure 17:
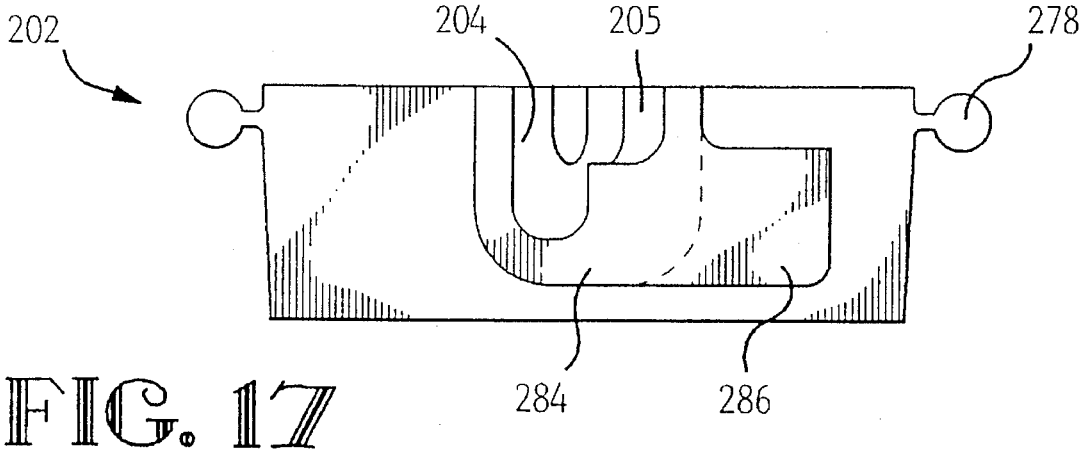
Figure 18:
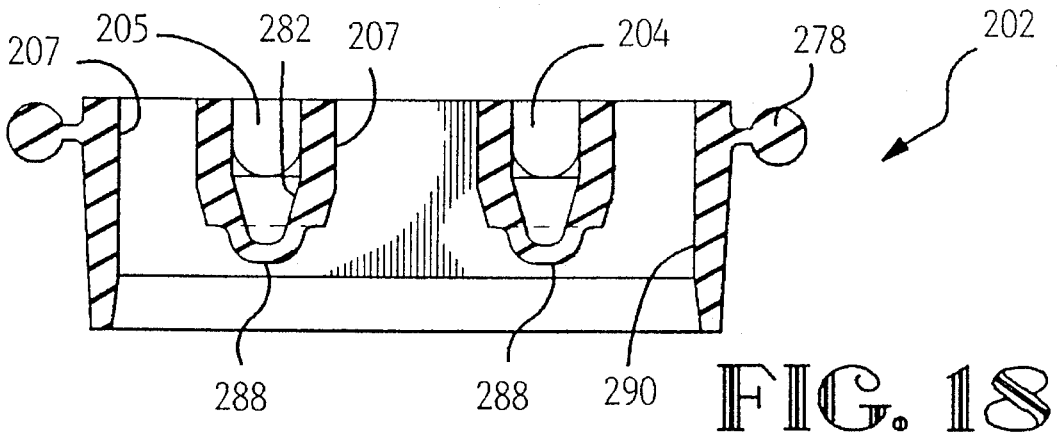
FIG. 18 is a cross sectional view of the wire nest of FIG. 14 taken along line 18—18.
Figure 19:
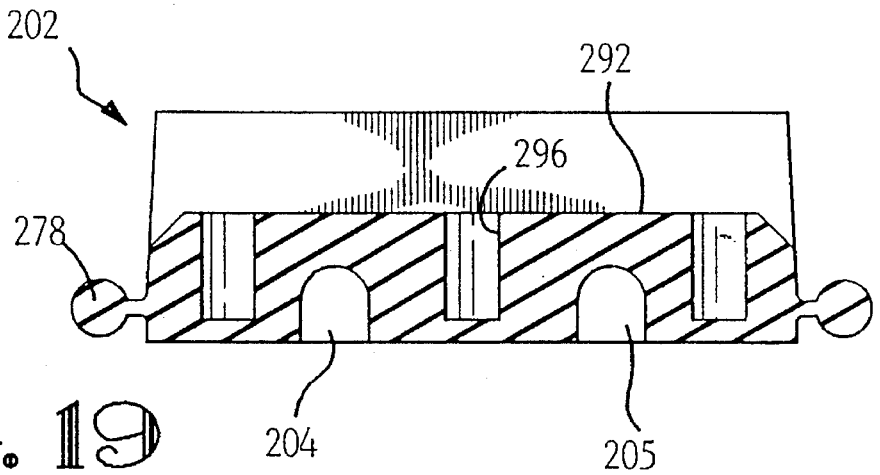
FIG. 19 is a cross sectional view of the wire nest of FIG. 16 taken along line 19—19.

Referring to FIG. 17, a side view of wire nest 202, the support surfaces of the wire receiving channels 204,205 at this position are made up of a lower channel and an upper channel positioned adjacent to each other. FIG. 18 is a partial cross sectional view of wire nest 202 of FIG. 13 taken along line 18—18 inwardly from the side surface. Wire receiving channels 204,205 and apertures 284 therein are shown. The profile of the medial slot 292 is shown in FIG. 19, having recesses 296 receiving thereinto post sections 298 along the top of low height wall section 294 traversing wire nest cavity 140 (FIG. 12).

Variations of the embodiments described above are possible. The coupler base is preferably formed from molded dielectric plastic material, such as nylon, or a liquid crystal polymer ("LCP"). Similar to the base, the mounting body members are preferably formed from molded dielectric plastic material, such as nylon, or a liquid crystal polymer. Wire retainers 200 may also be made of liquid crystal polymer, for example.

The coupler may be mounted on a vertical wall, a ceiling or floor, or in any position so that the air flow is received into the heat transfer fin channels. Moreover, a coupler as disclosed herein may be mounted in any manner in addition to the parallel, horizontal or flat mount methods described herein which are commonly utilized in the art, for example, by flush mounting.

Of course, it should be understood that a wide range of changes and modifications can be made to the preferred embodiment described above. It is therefore intended that the foregoing detailed description be understood that it is the following claims, including all equivalents, which are intended to define the scope of this invention.

What is claimed is:

1. An improved coupler for noninvasive coupling to conductors of a data bus cable, comprising:

a coupler base for mounting to a panel, and a housing couplable to said coupler base;

said coupler base including at least one electromagnet disposed therein with end faces of center and outer legs exposed across a housing-proximate face of said coupler base to become mated with end faces of corresponding legs of an opposed electromagnet secured in said housing upon coupling, to define electromagnet coils about said conductors of said data bus cable;

a wire nest surrounding said at least one electromagnet and including channels along a top surface extending between cable exits at opposed sides of said coupler base and coursing about respective sides of said center leg of said at least one electromagnet for receipt thereinto of a respective said conductor;

a wire retainer attached to said coupler base at a respective cable exit and movable between an open position and a closed position, where said open position permits placement of said conductors generally along respective said channels, said wire retainer includes a conductor-engaging surface adapted to engage and move both said conductors into said respective channels when said wire retainer is moved to said closed position to position said conductors fully into said respective channels and retain them therein, permitting mating engagement of said opposed electromagnets of each said pair upon coupling of said housing to said coupler base.

2. The coupler as set forth in claim 1 wherein said wire retainer includes a cover that extends from a side thereof for protectively covering portions of said conductors adjacent said cable exits.

3. The coupler as set forth in claim 1 wherein a conductor-engaging wedge is defined on said conductor-engaging surface associated with and opposed from a deeper one of said channels of said wire nest and engageable with a respective said conductor to urge said respective conductor into said deeper one of said channels.

4. The coupler as set forth in claim 1 wherein each said wire retainer includes an arm defining said conductor-engaging surface, a strut extending from one end thereof to a cylindrical hinge cooperable with a hinge-receiving pivot region of said coupler base to permit rotation of said arm between said open and closed positions, and a latch at an opposed end thereof to enable latching to said coupler base when said wire retainer is rotated to said closed position.

5. The coupler as set forth in claim 4 wherein said wire retainer further comprises a lever extending outwardly from said other end of said arm so that external force may be applied thereto for rotating said wire retainer between said open and closed positions.

6. The coupler as set forth in claim 4 wherein said strut is dimensioned less than the diameter of said cylindrical hinge, said hinge-receiving pivot region of said coupler base is an opening just larger than said diameter of said cylindrical hinge and is defined between at least one pair of opposed embossments and adapted to receive said cylindrical hinge thereinto from beside said coupler base, and said hinge-receiving pivot region includes a gap extending outwardly therefrom between said opposed embossments dimensioned less than said dimension of said pivot region and just larger than said dimension of said strut, all enabling said wire retainer to be affixed to said coupler base by said cylindrical hinge being received into said pivot region from beside said coupler base as said strut is passing through said gap until moved past at least a first said pair of said opposed embossments, when said wire retainer is in an appropriate orientation aligning said cylindrical hinge and said strut with said pivot region and said gap respectively.

7. The coupler as set forth in claim 6 wherein a second pair of said opposed embossments is spaced inwardly from said first pair of opposed embossments a sufficient distance to define a spacing just wider than a width of said strut, providing clearance for said strut between said first and second pairs of opposed embossments and permitting said wire retainer to be freely pivoted between said open and closed positions.

8. The coupler as set forth in claim 4 wherein said wire retainer includes a vertical section depending from an opposed end of said arm, said latch is a projection defined on a hinge-proximate surface of said vertical section, and said coupler base includes a wall section beneath said arm of said wire retainer when in said closed position coextending along said vertical section thereof and containing a latch cavity cooperable with said projection for latching said wire retainer in said closed position.

* * * * *